US005119351A

United States Patent [19]

Gogniat

[11] Patent Number: 5,119,351

[45] Date of Patent: Jun. 2, 1992

[54] ARRANGEMENT FOR ATTACHING BRACELET STRANDS TO A WATCH CASE

[75] Inventor: Paul Gogniat, Bienne, Switzerland

[73] Assignee: Montres Rado S.A., Lengnau, Switzerland

[21] Appl. No.: 645,399

[22] Filed: Jan. 24, 1991

[30] Foreign Application Priority Data

Jan. 25, 1990 [CH] Switzerland ..... 243/90

[51] Int. Cl.[5] ..... G04B 37/00

[52] U.S. Cl. ..... 368/282; 224/177

[58] Field of Search ..... 368/280-282, 368/276; 224/165-180

[56] References Cited

U.S. PATENT DOCUMENTS

| | | | |
|---|---|---|---|
| 1,406,647 | 2/1922 | King | 224/177 |
| 2,820,275 | 1/1958 | Lancaster | 224/174 |
| 3,073,492 | 1/1963 | Berger | 224/167 |
| 4,825,427 | 4/1989 | Wollman | 368/282 |

FOREIGN PATENT DOCUMENTS

| | | |
|---|---|---|
| 2554691 | 5/1985 | France . |
| 288518 | 5/1953 | Switzerland . |
| 298954 | 8/1954 | Switzerland . |
| 321188 | 6/1957 | Switzerland . |
| 368427 | 11/1962 | Switzerland . |

*Primary Examiner*—Bernard Roskoski

*Attorney, Agent, or Firm*—Griffin Branigan & Butler

[57] ABSTRACT

This arrangement for attaching the strands (1) of a bracelet to the watch case (3) includes, for each of the strands, at least one horn (4) attached to the caseband (10) and a lug (5) for connecting the horn to the strand. The horn comprises at least two thin plates (6) cut out to shape and juxtaposed. A part of such plates is introduced into a blind housing (7) formed in the caseband to receive a pin (8) which is introduced into a first hole provided in the caseband and second holes (15) provided in the plates in order to secure the horn to the case.

15 Claims, 3 Drawing Sheets

ARRANGEMENT FOR ATTACHING BRACELET STRANDS TO A WATCH CASE

This invention concerns an arrangement for attaching strands of a bracelet to a watch case including a crystal and a caseband, said arrangement comprising for each of the strands at least one horn attached to the caseband and a lug for connecting the horn to the strand in a manner to permit pivoting of said strand on said horn.

BACKGROUND OF THE INVENTION

Horns subsequently connected onto the caseband have often been proposed. Where the caseband is round, this method of proceeding greatly facilitates the manufacture of the case as much for the machining as for the termination thereof since the caseband may be machined on a lathe without such machining being hindered by horns which would form an integral part of the caseband.

Such an arrangement is described for instance in the document CH-A-321 188 in which the caseband- bezel exhibits a circular groove in which is engaged at least a part of each horn, means being provided in order to maintain such part engaged within said groove and to assure thus the securing of the horn to the case. This method, however, necessitates a relatively complicated machining of the horns, initially for the part which is engaged in the groove and thereafter for the part of the horn which is visible and curved which receives the bracelet.

Another arrangement appears from reading the document CHA-368 427 in which the horn penetrates into a housing provided in the caseband and is maintained there by means of a fastening pin. The horn exhibited by this document is massive and necessitates likewise a long and complicated machining since one of its ends—that which is introduced into the caseband—is cylindrical and the other of its ends—that which serves for attaching the bracelet—is a parallelepipedon.

SUMMARY OF THE INVENTION

This invention also proposes horns attached onto the caseband, such horns being formed however in a much more simple manner from those described in the above cited documents. To this purpose the arrangement for attaching the bracelet strands to the watch case is characterized by the fact that the horn includes at least two thin plates cut out to shape and juxtaposed, a part of said plates being introduced into a blind housing exhibited by the caseband in order to receive a pin which is introduced at the same time into a first hole provided in the caseband and into second holes provided in the plates in order to secure said horn to said case.

The invention will now be described by means of the description to follow and with the aid of the drawings which illustrate it by way of example.

DESCRIPTION OF THE PREFERRED EMBODIMENTS

Figure 1:
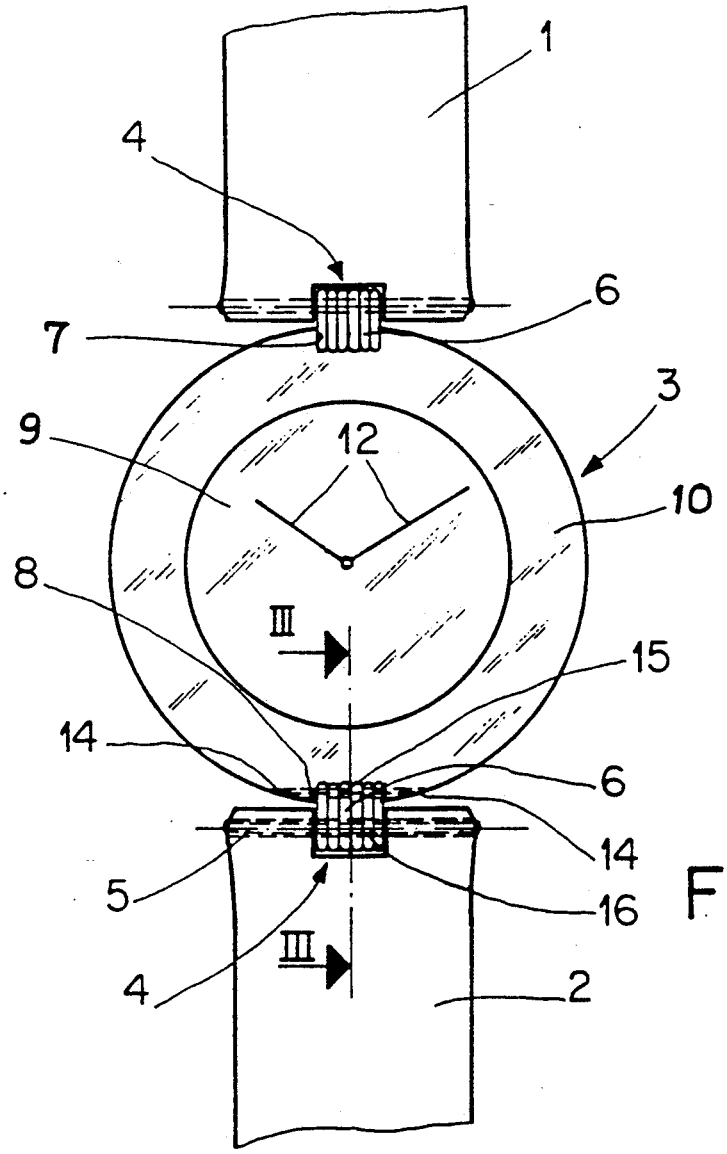
FIG. 1 is a face view of a first embodiment of a watch on which appears the attachment arrangement according to the invention, such arrangement employing cut out horns.

There has been shown on FIG. 1 a wristwatch including a case 3 to which are attached two strands 1 and 2 of a bracelet. The case 3 includes a caseband 10, a crystal 9 through which one may distinguish time displaying hands 12 and a back cover 11. The attachment arrangement comprises, for each of strands 1 and 2, a horn 4 which is attached to the caseband. A lug 5 connects the horn to the strand so as to permit in a known manner pivoting of the strand on the horn.

According to an essential characteristic of the invention, horn 4 includes at least two plates 6 cut out to shape and juxtaposed, then partially introduced into a blind housing 7 provided in caseband 10. A pin 8 is received at the same time in a hole 14 provided in the caseband and in second holes 15 provided in the plates in order to secure the horn to the case. By blind housing it is here necessary to understand a housing provided within the thickness of the caseband and leaving material between the interior of the case and the exterior of the latter. Such housing includes a bottom 25 (see FIG. 3).

Figure 3:
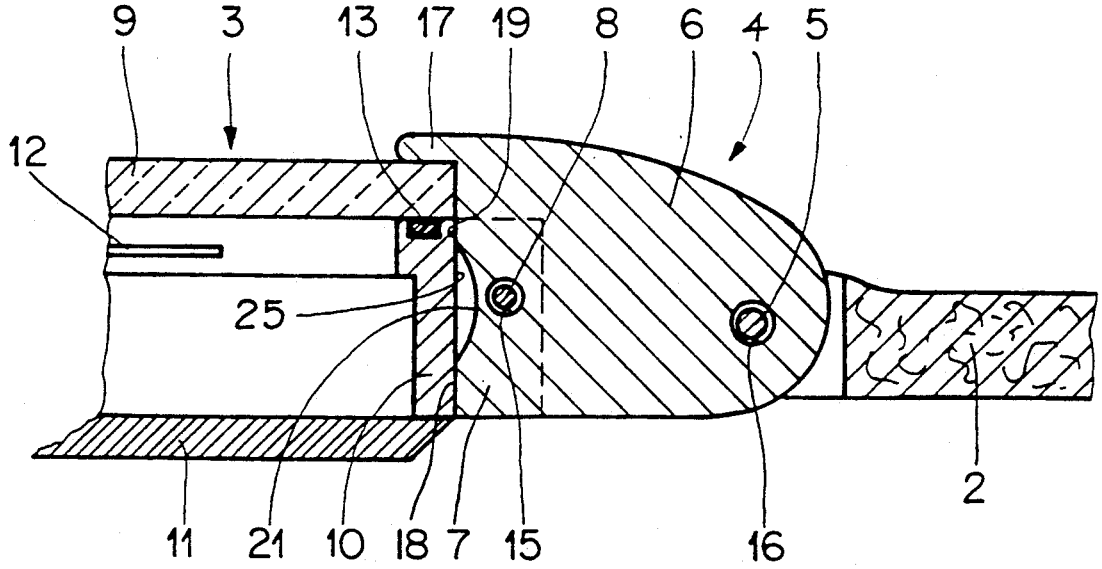
FIG. 3 is a cross-section along line III—III of FIG. 1.

FIG. 3 which is a cross-section along line III—III of FIG. 1, clearly shows how a plate 6 of horn 4 is fitted relative to the caseband 10. In the caseband 10 there is formed the blind housing 7 which exhibits bottom 25. One next introduces the plates into the housing, then one drives the pin 8, initially into the first hole 14 provided in the caseband, then into the second hole 15 provided in the plate, and finally into the first hole 14 provided in the caseband (see also FIG. 1). Figure 3 further shows that strand 2 of the bracelet is attached to horn 4 by means of the lug 5 introduced into a hole 16 provided in plates 6 of horn 4.

To eliminate all mobility from plate 6 when it is secured to the caseband, the arrangement is such that an edge face of plate 6 comes into elastic abuting contact with the bottom 25 of housing 7 when the pin 8 is introduced into holes 14 and 15. This is brought about advantageously, as may be seen on FIG. 3, by providing on the edge face of the plate a clearance 21 which defines two support zones 18 and 19, the means permitting the elastic deformation of the edge face consisting in weakening the plate between the bottom of the clearance 21 and the hole 15 which brings about flexing of the edge face when the pin 8 is introduced into holes 14 and 15.

FIGS. 1 and 3 further show that one may take advantage of the presence of horns 4 in order to secure crystal 9 onto caseband 10 in a sealed manner. For this purpose plate 6 includes a projection or overhang 17 which engages the crystal and presses it onto the caseband. Sealing is assured by a packing 13 squeezed between the crystal and the caseband.

Figure 4:
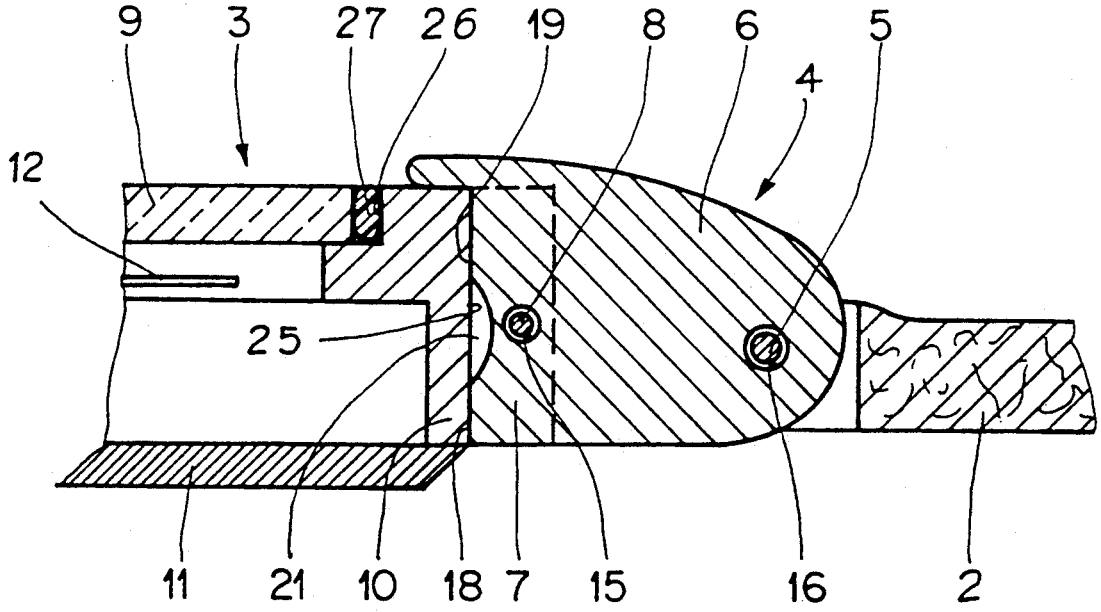
FIG. 4 is a cross-section showing a variant of the cross-section illustrated by FIG. 3.

FIG. 4 is a cross-section showing a variant of the cross-section shown on FIG. 3. The sole difference consists in securing crystal 9 in a bed 26 situated on the top portion of the caseband 10, a packing 27 assuring sealing, the plate 6 here contributing nothing to the securing of the crystal onto the caseband.

Figure 2:
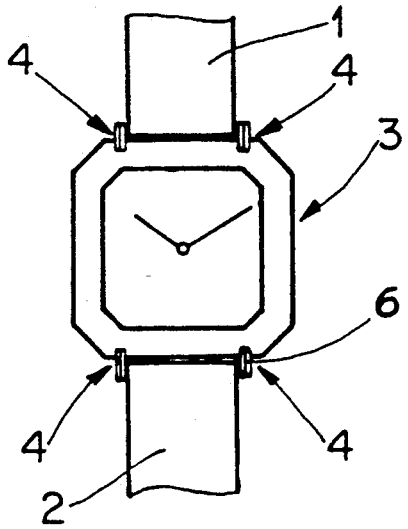
FIG. 2 is a face view of a second embodiment of a watch on which appears the attaching arrangement according to the invention.

FIG. 2 shows a face view of a second embodiment of the attaching arrangement according to the invention. Here each strand of the bracelet is attached to case 3 by means of two horns 4 each showing two plates 6. The securing of the plates is brought about in a manner similar to that which has been described hereinabove.

Figure 5:
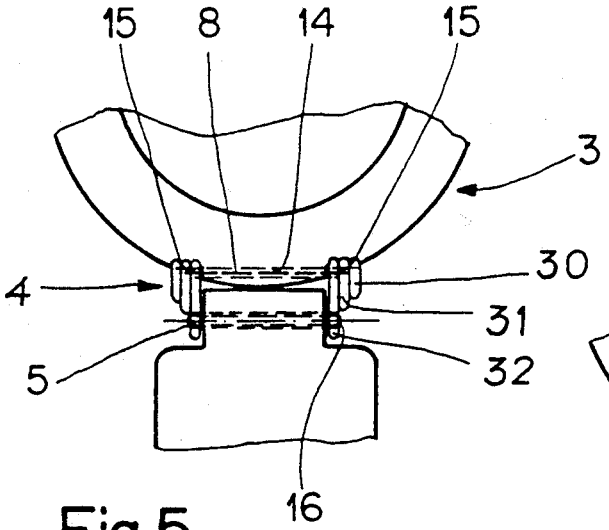
FIG. 5 is a partial face view of a watch equipped with the arrangement according to the invention and according to a variant of FIG. 2.

FIGS. 1 and 2 further show horns 4 formed by a plurality of plates 6 cut into form and juxtaposed. In these examples, the plates forming the horn all show a same cutting. In the case of FIG. 5 on the other hand, each horn is formed of three plates 30, 31 and 32 the cuttings of which are different and this with the purpose of seeking an original design. If the three plates are secured to the case by pin 8 already described hereinabove, strand 2 of the bracelet is attached to the horns 4 only by the end of the plate 32 by means of lug 5.

Figure 6:
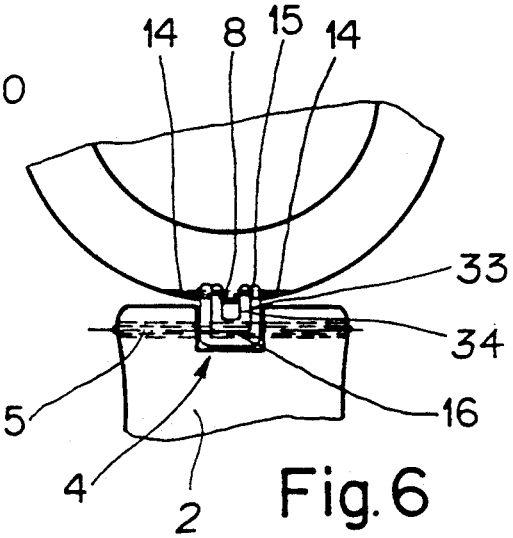
FIG. 6 is a partial face view of an attaching arrangement utilizing cut out and bent horns according to a first embodiment.
Figure 7:
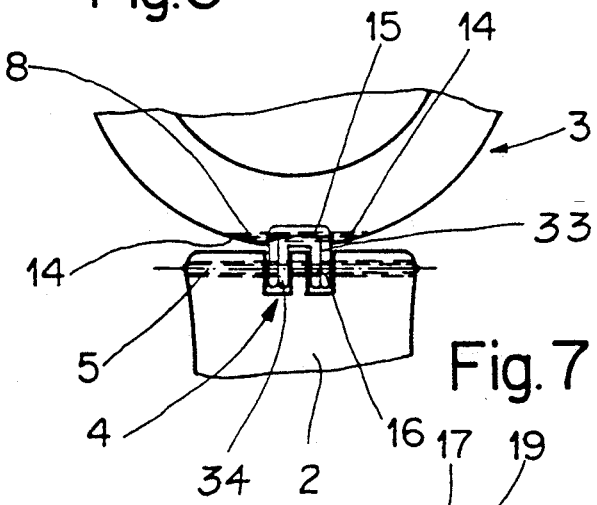
FIG. 7 is a partial view of an attaching arrangement utilizing horns which are cut out and bent according to a second embodiment.

Reference will now be had to FIGS. 6 and 7. In these two figures the horns are made from plates 33 and 34 which are cut out, then bent into U form. In the case of FIG. 6, the free ends of the U are supported on the bottom of the blind housing provided in the caseband and the base of the U is arranged to receive the pivot lug for the bracelet strand. Inversely, in FIG. 7 it is the base of the U which is supported on the bottom of the blind housing, while the free ends of the U are arranged in order to receive the pivot lug for the bracelet strand.

The embodiments which have been described show that the arrangement claimed and which calls for blanked plates enables a large number of variants thanks to which the final aspect of the watch may be modified. There will be mentioned in addition that the plates may be blanked from a same band by means of a die. In this case all the plates would have the same colouring. The base material may be steel or gold. One can also envisage alternating the two materials, for instance steel and gold in order to obtain a bicoloured aspect. Whatever be the material employed, it will be noted that the plates forming the horn are easy to manufacture without any complex machining since obtained by blanking. From this fact the attachment arrangement is inexpensive while showing an attractive and novel allure.

Figure 8:
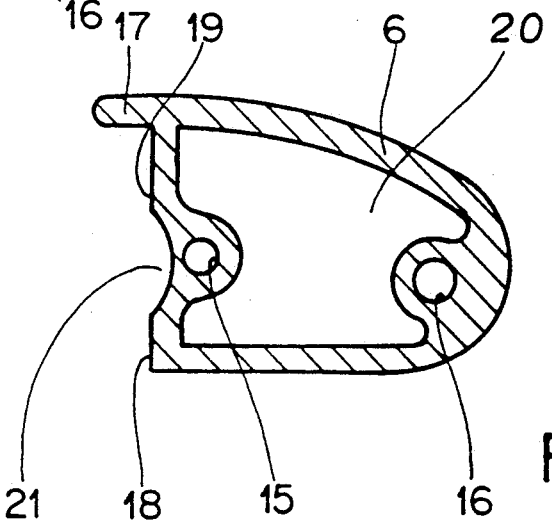
FIG. 8 shows a special execution of a plate forming the horn as a variant to that shown on FIG. 3.

FIG. 8 shows a particular form of plate 6. Here there is recognized the support zones 18 and 19, projection 17, clearance 21 and holes 15 and 16 respectively receiving the securing pin for the plate onto the caseband and the attaching lug for the bracelet strand to the plate. Beyond the configuration described hereinabove, the plate exhibits an interior cut out 20 which is blanked at the same time as the outer contour of the plate, this cut-out enabling an economy of the material, particularly if the plate is made of gold.

What is claimed is:

1. In a watch having a watch case including a crystal and a caseband and a bracelet having strands, an arrangement for attaching said strands to said watch case, said arrangement comprising for each of said strands, at least one horn attached to said caseband and a lug for connecting said horn to said strand in a manner to permit pivoting of said strand on said horn, said horn including at least two independent thin plates cut out to shape and juxtaposed, a part of said plates extending into a blind housing exhibited by said caseband in order to receive a pin which is introduced at the same time into a first hole provided in the caseband and into second holes extending through said plates in order to secure said horn to said watch case;

said blind housing exhibiting a bottom against which an edge face exhibited by the plates comes into abutting contact, and means bringing about elastic deformation of said edge face when said pin is introduced into said first and second holes to assure a bearing force between said plates and said bottom.

2. An arrangement as set forth in claim 1 wherein said plates exhibit projections for securing said crystal onto said caseband.

3. An arrangement as set forth in claim 1 wherein said edge face exhibits a clearance arranged to form two bearing zones for said edge face against said bottom when said pin is introduced into said first and second holes.

4. An arrangement as set forth in claim 1 wherein said cut plates forming said horn are bent into a U form having free ends of the U bearing against said bottom of the blind housing and a base of the U form being arranged to receive said pivot lug for said bracelet strand.

5. An arrangement as set forth in claim 1 wherein said cut plates forming the horn are bent into a U form having a base of the U bearing against said bottom of said blind housing and free ends arranged to receive said pivot lug for the bracelet strand.

6. An arrangement as set forth in claim 1 wherein said horn includes a plurality of cut out and juxtaposed plates and wherein each a of said plates exhibit an identical cutting.

7. An arrangement as set forth in claim 1 wherein said horn includes a plurality of cut out and juxtaposed plates and wherein each of said plates exhibits a different cutting.

8. An arrangement as set forth in claim 6 wherein said plates are cut out from the same material.

9. An arrangement as set forth in claim 6 wherein said plates are cut out from different materials.

10. An arrangement as set forth in claim 1 wherein said plates exhibit an interior cutout.

11. An arrangement as set forth in claim 10 wherein said plates are made of gold.

12. An arrangement as set forth in claim 7 wherein said plates are cut out from the same material.

13. An arrangement as set forth in claim 7 wherein said plates are cut out from different materials.

14. In a watch having a watch case including a crystal and a caseband and a bracelet having strands, an arrangement for attaching said strands to said watch case, said arrangement comprising, for each of said strands, at least one horn attached to said caseband and a lug for pivotally connected said horn to said strand, said horn comprising at least two thin plates, said caseband having a blind housing for receiving at least a part of each of said thin plates, said thin plates each having a hole in said part, a hole in said caseband, and a pin extending into the holes in said thin plates and said caseband to affix said horn to said caseband, said thin plates each having an edge abuting a surface of said caseband within said blind housing to prevent rotational movement of said thin plates about said pin.

15. In a watch having a watch case including a crystal and a caseband and a bracelet having strands, an arrangement for attaching said strands to said watch case, said arrangement comprising, for each of said strands, at least one horn attached to said caseband and a lug connecting said horn to said strand in a manner to permit pivoting of said strand on said horn, said horn including at least two thin plates cut out to shape and juxtaposed, a part of said plates extending into a blind housing exhibited by said caseband in order to receive a pin which is introduced at the same time into a first hole provided in the caseband and into second holes extending through said plates in order to secure said horn to said watch case, and a projection on each of said plates extending over said crystal to press said crystal against said caseband.

* * * * *